US009406273B2

(12) United States Patent
Kim et al.

(10) Patent No.: US 9,406,273 B2
(45) Date of Patent: Aug. 2, 2016

(54) FLAT PANEL DISPLAY APPARATUS AND SOURCE DRIVER IC

(71) Applicant: SILICON WORKS CO., LTD., Daejeon-si (KR)

(72) Inventors: Young Bok Kim, Daejeon-si (KR); Pyung Sik Ma, Daejeon-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 53 days.

(21) Appl. No.: 14/472,480

(22) Filed: Aug. 29, 2014

(65) Prior Publication Data

US 2015/0062107 A1 Mar. 5, 2015

(30) Foreign Application Priority Data

Aug. 30, 2013 (KR) ..... 10-2013-0104263

(51) Int. Cl.
*G09G 3/36* (2006.01)
*G09G 3/20* (2006.01)

(52) U.S. Cl.
CPC ..... *G09G 3/3688* (2013.01); *G09G 3/20* (2013.01); *G09G 2300/0426* (2013.01); *G09G 2310/0275* (2013.01); *G09G 2310/0291* (2013.01); *G09G 2330/02* (2013.01)

(58) Field of Classification Search
CPC ..... G09G 2300/0426; G09G 3/3688; G09G 3/3696; G09G 2310/027; G09G 2370/08; G09G 2310/0291; G09G 3/3685; G02F 1/13452
USPC ..... 345/211, 204, 212; 349/149, 150, 151
See application file for complete search history.

(56) References Cited

U.S. PATENT DOCUMENTS

2004/0135956 A1* 7/2004 Kim ..... G02F 1/1345 349/148
2006/0022969 A1* 2/2006 Lee ..... G02F 1/136286 345/211
2007/0200842 A1 8/2007 Tokuda et al.
2009/0224241 A1* 9/2009 Yoshida ..... H01L 23/5386 257/48
2010/0020057 A1* 1/2010 Shin ..... G09G 3/006 345/211
2011/0193844 A1* 8/2011 Lee ..... G09G 3/3648 345/211

FOREIGN PATENT DOCUMENTS

KR 10-0782303 12/2007
KR 10-0851197 8/2008
KR 10-2009-0042451 4/2009
KR 10-1244773 3/2013
KR 10-1341912 12/2013

* cited by examiner

*Primary Examiner* — Koosha Sharifi-Tafreshi
(74) *Attorney, Agent, or Firm* — Kile Park Reed & Houtteman PLLC

(57) ABSTRACT

Disclosed are a flat panel display apparatus and a source driver integrated circuit. The flat panel display apparatus and the source driver integrated circuit supply power to each position in the source driver integrated circuit at a uniform level, so that the output characteristics of a plurality of units using the power are uniform.

18 Claims, 3 Drawing Sheets

FLAT PANEL DISPLAY APPARATUS AND SOURCE DRIVER IC

BACKGROUND

1. Technical Field

The present disclosure relates to a flat panel display apparatus, and more particularly, to a flat panel display apparatus having improved power routing of a source driver integrated circuit and a source driver integrated circuit mounted thereon.

2. Related Art

Recently, most display apparatuses are flat panel display apparatuses. A representative flat panel display apparatus is a liquid crystal display apparatus. The liquid crystal display apparatus displays image data by a pixel-based optical shutter operation using a characteristic in which an arrangement state of liquid crystal molecules is changed according to voltage environments.

The liquid crystal display apparatus includes source driver integrated circuits that provide source driving signals for displaying an image on display panels. The source driver integrated circuits receive power required for operations from external power supplies, and the power is supplied to the same parts or different parts in the source driver integrated circuits. However, the power may be supplied at different levels according to the position of each part by the line resistance difference of internal paths of the source driver integrated circuit.

In more detail, one of the power provided to the source driver integrated circuits is a half supply voltage (Half VDD, hereinafter, referred to as "HVDD"). The half supply voltage HVDD may be used when a channel amplifier outputs a source driving signal or a gamma circuit provides a gamma voltage.

In each source driver integrated circuit, a large number of channel amplifiers are arranged in an array, wherein each channel amplifier may be configured to output a source driving signal by using the half supply voltage HVDD.

In the conventional source driver integrated circuit, the half supply voltage HVDD may be supplied to each channel amplifier at different levels by the difference of line resistances of internal paths of the source driver integrated circuit. The half supply voltage HVDD applied to a specific power pad of the source driver integrated circuit may be supplied to the center of an array, and may be supplied to an edge side according to an order arranged in the array. That is, the difference of line resistances may occur between the power pad and each channel amplifier. Therefore, the half supply voltage HVDD supplied to each channel amplifier may not be uniform by the difference of line resistances.

Since the output characteristics according to channel amplifiers of the source driver integrated circuit may be changed as described above, a problem such as block dim may occur on a display panel.

SUMMARY

Various embodiments are directed to a flat panel display apparatus in which power can be supplied to each position in a source driver integrated circuit at a uniform level and the output characteristics of a plurality of units using the power can be uniform, and a source driver integrated circuit.

Various embodiments are directed to a flat panel display apparatus in which a half supply voltage can be provided at a uniform level to channel amplifiers arranged in an array in a source driver integrated circuit mounted on a film, and a source driver integrated circuit.

In an embodiment, a flat panel display apparatus includes: a source driver integrated circuit including units, which is commonly applied same power to driving terminals and is arranged at both sides about a center to form an array, a first power pad and a plurality of second power pads for the power formed, and nodes formed corresponding to both edges and the center of the array and the plurality of second power pads are connected to have a same line resistance; and a film mounted thereon with the source driver integrated circuit, and formed a first power line connected to the first power pad and second power lines connected to the plurality of second power pads, one end of the second power lines being commonly connected to each other.

In an embodiment, a flat panel display apparatus includes: a printed circuit board including a stabilization capacitor and providing a first half supply voltage and a second half supply voltage charged in the stabilization capacitor; a film formed a first power line for routing of the first half supply voltage and a plurality of second power lines for routing of the second half supply voltage; and a source driver integrated circuit mounted on the film, and formed a first power pad for a connection to the first power line, a plurality of second power pads for a connection to the plurality of second power lines, and including an amplifier that amplifies and outputs the first half supply voltage of the first power pad, units commonly using a second half supply voltage output from the amplifier and arranged at both sides about a center to form an array, and nodes formed corresponding to both edges and the center of the array and the plurality of second power pads are connected to have a same line resistance.

In an embodiment, a source driver integrated circuit includes: a first power pad for input of a half supply voltage; a plurality second power pads for output of the half supply voltage routed in the source driver integrated circuit; an amplifier that amplifies and outputs the half supply voltage of the first power pad; and units commonly using the half supply voltage output from the amplifier and arranged at both sides about a center to form an array, wherein nodes formed corresponding to both edges and the center of the array are connected to the plurality of second power pads to have a same line resistance.

In an embodiment, a flat panel display apparatus includes: a first power pad for supplying a first half supply voltage; power lines having first ends commonly connected to each other and supplying a second half supply voltage; a plurality of second power pads connected to second ends of the power lines, connected to each other by interconnections formed in a source driver integrated circuit, and supplying the second half supply voltage to both edges and a center of units arranged in the source driver integrated circuit to form an array; and a half supply voltage amplifier having an output terminal connected to the plurality second power pads by the interconnections, amplifying the first half supply voltage supplied from the first power pad, and outputting the second half supply voltage.

The present invention has a structure in which power lines and power pads for supplying power to the source driver integrated circuit are connected in parallel to each other, so that the overall line resistance can be reduced.

Furthermore, according to the present invention, it is possible to uniformly supply power to units such as channel amplifiers forming an array in the source driver integrated circuit formed in a chip-on-film type. As a consequence, a source driving signal of the source driver integrated circuit can be stabilized, and a phenomenon such as block dim can be prevented from occurring.

DETAILED DESCRIPTION

Figure 1:
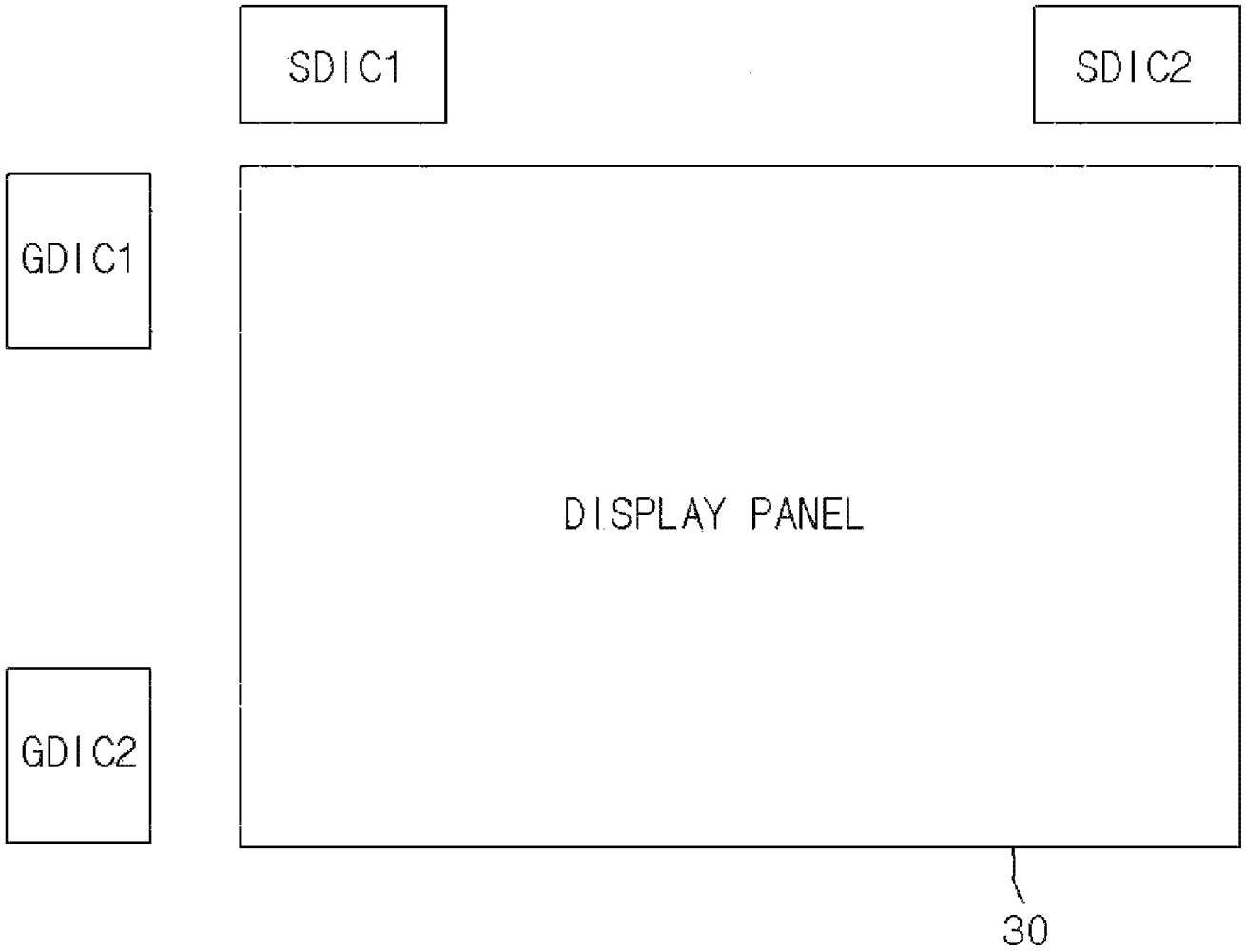
FIG. 1 is a block diagram illustrating an embodiment of a flat panel display apparatus according to the present invention.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

A flat panel display apparatus according to an embodiment of the present invention may be implemented by having a light emitting diode (LED) panel, a liquid crystal display (LCD) panel, a plasma display panel (PDP) and the like as a display panel.

The flat panel display apparatus according to an embodiment of the present invention may include a display panel 30 that displays an image by using a gate driving signal and a source driving signal, gate driver integrated circuits GDIC1 and GDIC2 that provide the gate driving signal, source driver integrated circuits SDIC1 and SDIC2 that provide the source driving signal, a power supply (not illustrated) that supplies power to the gate driver integrated circuits GDIC1 and GDIC2 and the source driver integrated circuits SDIC1 and SDIC2, and the like as illustrated in FIG. 1. As described above, the display panel 30 may include a light emitting diode panel, a liquid crystal display panel, a plasma display panel and the like. Hereinafter, for the purpose of convenience, the display panel 30 is implemented as the liquid crystal display panel. In the embodiment of FIG. 1, two source driver integrated circuits SDIC1 and SDIC2 and two gate driver integrated circuits GDIC1 and GDIC2 are provided, and other source driver integrated circuits or other gate driver integrated circuits provided between the source driver integrated circuits SDIC1 and SDIC2 or between the gate driver integrated circuits GDIC1 and GDIC2 are not illustrated.

The flat panel display apparatus may further include a timing controller (not illustrated) that controls the operations of the gate driver integrated circuits GDIC1 and GDIC2 and the source driver integrated circuits SDIC1 and SDIC2, wherein the timing controller may be integrally formed with one of the source driver integrated circuits SDIC1 and SDIC2, or may be mounted as a separate chip.

Figure 2:
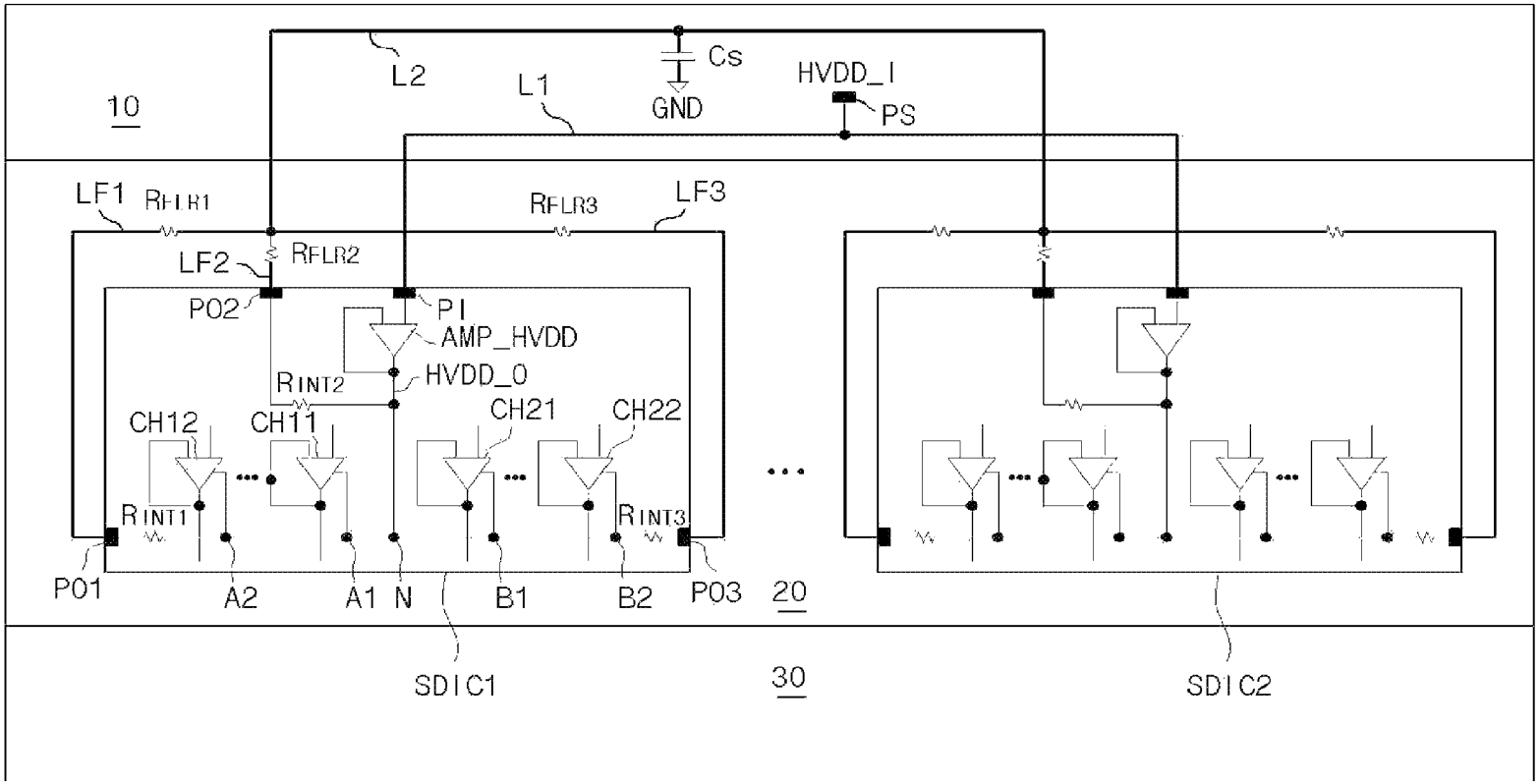
FIG. 2 is a circuit diagram illustrating an embodiment of a power routing structure of a source driver integrated circuit of FIG. 1.

The flat panel display apparatus may be provided as a module in which a unit has been mounted on a printed circuit board (PCB) (10 of FIG. 2) or a film (20 of FIG. 2). In this case, the unit indicates parts forming an array as with a channel amplifier, which will be described later, and including one or more elements. The film 20 and the printed circuit board 10 are configured to be electrically connected to each other by using a conductive film (not illustrated). A power supply may be mainly mounted on the printed circuit board 10, and the source driver integrated circuits SDIC1 and SDIC2 may be mounted on the film 20 in a chip-on-film (COF) type. The gate driver integrated circuits GDIC1 and GDIC2 may also be mounted on a separate film (not illustrated) in a COF type.

The embodiment of the present invention has a structure in which power provided from the printed circuit board 10 is routed to the source driver integrated circuits SDIC1 and SDIC2 via the film 20 and routing paths in the source driver integrated circuits SDIC1 and SDIC2 match with routing paths on the film 20, as illustrated in FIG. 2.

In more detail, referring to FIG. 2, the embodiment of FIG. 2 discloses a structure in which a half supply voltage HVDD (an example of power) is routed. The power supply provides a supply voltage at a high level corresponding to a ground voltage GND at a low level for the purpose of analog operations of units. The supply voltage may be defined as "VDD". The half supply voltage HVDD may be defined as a voltage having a half level of the supply voltage. The half supply voltage HVDD may be used when a channel amplifier outputs a source driving signal or a gamma circuit provides a gamma voltage in the source driver integrated circuits.

In the embodiment of FIG. 2, the printed circuit board 10, the film 20, and the display panel 30 are arranged. Sides of the printed circuit board 10 and the film 20, which face each other, and sides of the film 20 and the display panel 30, which face each other, are electrically connected to each other by a conductive film (not illustrated).

Among the elements, the printed circuit board 10 may be mounted thereon with a power supply (not illustrated) for supplying power and a timing controller (not illustrated) for providing image data for display. The film 20 may be mounted thereon with the source driver integrated circuits SDIC1 and SDIC2 in a COF type. In the embodiment of FIG. 2, two source driver integrated circuits SDIC1 and SDIC2 are mounted on the film 20. Other source driver integrated circuits arranged between the source driver integrated circuits SDIC1 and SDIC2 are not illustrated.

In more detail, on the printed circuit board 10, a stabilization capacitor CS, a power pad PS, and a plurality of power lines L1 and L2 are formed. The plurality of power lines L1 and L2 are configured to correspond to the number of the source driver integrated circuits SDIC1 and SDIC2. One end of the stabilization capacitor CS is connected to the ground voltage GND, and the other end of the stabilization capacitor CS is commonly connected to the plurality of power lines L2. The power pad PS is commonly connected to the plurality of power lines L1.

The aforementioned power pad PS may be described as an element that supplies the half supply voltage HVDD as power for example. When the half supply voltage is generically indicated, "HVDD" is written. In order to describe the embodiment, a half supply voltage HVDD applied from the power pad PS to input terminals of half supply voltage amplifiers AMP_HVDD in the source driver integrated circuits SDIC1 and SDIC2 is written as "HVDD_I" and a half supply voltage HVDD output from output terminals of the half supply voltage amplifiers AMP_HVDD is written as "HVDD_O".

Each of the power lines L1 and L2 is formed over the printed circuit board 10 and the film 20, and each of the power lines L1 and L2 can extend from the printed circuit board 10 to the film 20 through an electrical connection by the conductive film between the printed circuit board 10 and the film 20 as described above.

The source driver integrated circuits SDIC1 and SDIC2 are mounted on the film 20, and for a description of the embodiment, only the power routing structure of the source driver integrated circuit SDIC1 will be described. Since routing structures of other source driver integrated circuits are equal to the power routing structure of the source driver integrated circuit SDIC1, a description thereof will be omitted in order to avoid redundancy. Furthermore, power lines LF1, LF2, and LF3 connected in parallel to the power line L2 on the film 20 are formed for power routing.

In the embodiment of FIG. 2, the source driver integrated circuit SDIC1 includes four power pads PI, PO1, PO2, and PO3 for the same power, that is, the half supply voltage HVDD. The power pad PI is provided to receive the half supply voltage HVDD_I, and the other three power pads PO1, PO2, and PO3 are provided to supply the half supply voltage HVDD_O routed in the source driver integrated circuit SDIC1 to units forming an array in the source driver integrated circuit SDIC1. The power pad PI is connected to the power line L1 to which the half supply voltage HVDD_I is applied, and the three power pads PO1, PO2, and PO3 are connected to the power lines LF1, LF2, and LF3, respectively.

The power lines LF1, LF2, and LF3 route the half supply voltage HVDD_O routed in the source driver integrated circuit SDIC1. Preferably, line resistors $R_{FLR1}$, $R_{FLR2}$, and $R_{FLR3}$ of the power lines LF1, LF2, and LF3 are designed to have substantially the same resistance value.

The source driver integrated circuit SDIC1 includes units arranged at both sides about the center N and forming an array. The same half supply voltage HVDD_O is commonly applied to driving terminals of such units. As an example of the units, channel amplifiers CH11, CH12, CH21, and CH22 may be provided in FIG. 2. The driving terminals indicate terminals to which the half supply voltage HVDD_O is supplied, and VCOM of a channel amplifier illustrated as an example in FIG. 3 may be understood to correspond to the half supply voltage HVDD_O that is routed in the source driver integrated circuit.

Furthermore, in the source driver integrated circuit SDIC1, a half supply voltage amplifier AMP_HVDD may be provided to receive the half supply voltage HVDD_I to output the half supply voltage HVDD_O. That is, the source driver integrated circuit SDIC1 includes the half supply voltage amplifier AMP_HVDD and the channel amplifiers CH11, CH12, CH21, and CH22 arranged in an array.

In the embodiment of FIG. 2, only the half supply voltage amplifier AMP_HVDD and the channel amplifiers CH11, CH12, CH21, and CH22 are illustrated in order to describe the routing of the half supply voltage HVDD of the source driver integrated circuit SDIC1, and units for converting received image data into a source driving signal are not illustrated. Furthermore, as the channel amplifiers arranged in an array, the channel amplifiers CH11 and CH12 nearest to the center N of the array and the channel amplifiers CH21 and CH22 positioned at the edges of the array are illustrated, and channel amplifiers between the channel amplifiers CH11 and CH12 and channel amplifiers between the channel amplifiers CH21 and CH22 are not illustrated. As described above, the center N of the array indicates a boundary area (or a node) obtained by dividing the array by two about the center N such that the same number of channel amplifiers CH11, CH12, CH21, and CH22 are included.

Between input terminals of the half supply voltage amplifier AMP_HVDD, one is connected to the power pad PI to which the half supply voltage HVDD_I is applied, and the other is connected to an output terminal in order to form a feedback loop. The output terminal of the half supply voltage amplifier AMP_HVDD is commonly connected to the driving terminals of the channel amplifiers CH11, CH12, CH21, and CH22 included in the array.

In this case, the output terminal of the half supply voltage amplifier AMP_HVDD is connected to the driving terminals of the channel amplifiers CH11, CH12, CH21, and CH22 by using interconnections that extend toward both edges of the source driver integrated circuit SDIC1 via the center N of the array. Furthermore, the output terminal of the half supply voltage amplifier AMP_HVDD is connected to the power pads PO1, PO2, and PO3 through interconnections formed in the source driver integrated circuit SDIC1. An interconnection for supplying the output of the half supply voltage amplifier AMP_HVDD, that is, the half supply voltage HVDD_O is formed to extend along the array, and nodes A1, A2, B1, and B2 for connections to the driving terminals of the channel amplifiers CH11, CH12, CH21, and CH22 are formed on the interconnection. The driving terminals of the channel amplifiers CH12 and CH22 arranged at the edges of the array are connected to the power pads PO1 and PO3 via the nodes A2 and B2 formed in the interconnection, respectively. The driving terminals of the channel amplifiers CH11 and CH21 arranged at the center N of the array are connected to the power pad PO2 via the nodes A1 and B1 formed in the interconnection. The power pads PO1, PO2, and PO3 are connected to the power lines LF1, LF2, and LF3, respectively, and are connected to one another through the interconnections formed in the source driver integrated circuit SDIC1. In this case, the power lines LF1, LF2, and LF3 have a structure in which one end of the power line LF1, one end of the power line LF2, and one end of the power line LF3 are commonly connected to one another, the other end of the power line LF1, the other end of the power line LF2, and the other end of the power line LF3 are connected to the power pads PO1, PO2, and PO3, and the power lines LF1, LF2, and LF3 are connected in parallel to one another by the interconnections for connecting the power pads PO1, PO2, and PO3 to one another. Preferably, a line resistor $R_{INT1}$ between the power pad PO1 and the node A2, a line resistor $R_{INT3}$ between the power pad PO3 and the node B2, and a line resistor $R_{INT2}$ between the power pad PO2 and the nodes A1 and B1 are set to have the same resistance value. That is, it is preferable that the line resistors $R_{INT1}$ and $R_{INT3}$ between the nodes A2 and B2 connected to the driving terminals of the channel amplifiers CH12 and CH22 arranged at the edges of the array and the power pads PO1 and PO3 and the line resistor $R_{INT2}$ between the nodes A1 and B1 connected to the driving terminals of the channel amplifiers CH11 and CH21 arranged at the center N of the array and the power pad PO2 are set to have the same resistance value.

As described above, the embodiment of the present invention has a structure in which the power lines LF1, LF2, and LF3 and the power pads PO1, PO2, and PO3 for supplying power to the source driver integrated circuits are connected in parallel to each other, thereby reducing the overall line resistance. Furthermore, according to the embodiment of the present invention, the half supply voltage HVDD_O is supplied to the edges and the center of the array through the power pads PO1, PO2, and PO3 connected to the power lines LF1, LF2, and LF3 connected in parallel to one another, so that voltage drops at the driving terminals of the channel amplifiers CH11, CH12, CH21, and CH22 can be uniform.

Furthermore, according to the embodiment of the present invention, line resistances between the power pad PO2 and the node A1, between the power pad PO2 and the node B1, between the power pad PO1 and the node A2, and between the power pad PO3 and the node B2 are configured to be uniform, so that the half supply voltage HVDD_O can be applied to the driving terminals of the channel amplifiers CH11, CH12, CH21, and CH22 at a uniform level.

A detailed description will be provided for the case in which the half supply voltage HVDD_O is applied to the driving terminals of the channel amplifiers CH11, CH12, CH21, and CH22 at a uniform level. Voltage drops at the driving terminals of the channel amplifiers between the node A1 and the node A2 are uniform. This is because the sum of a resistance value for the node A1 and a resistance value for the node A2 is uniform according to the driving terminals of the channel amplifiers between the node A1 and the node A2. By this reason, voltage drops at the driving terminals of the channel amplifiers between the node B1 and the node B2 are also uniform. Furthermore, since the power pads PO1, PO2, and PO3 are connected to the stabilization capacitor CS on the printed circuit board 10 through the power lines LF1, LF2, and LF3 and the power line L2, the internally routed half supply voltage HVDD_O can be stabilized.

Consequently, in the embodiment according to the present invention, the half supply voltage HVDD_O applied to the driving terminals of the channel amplifiers CH11, CH12, CH21, and CH22, which are units arranged in an array in the source driver integrated circuit SDIC1, can be uniform and stabilized.

As a consequence, in the embodiment according to the present invention, the difference among the slew rates of the channel amplifiers CH11, CH12, CH21, and CH22 can be solved and the output characteristics can be uniform, and source driving signals output from the channel amplifiers CH11, CH12, CH21, and CH22 can be stabilized, so that it is possible to prevent the occurrence of a phenomenon such as block dim.

Furthermore, in the embodiment according to the present invention, by the aforementioned configuration and operation, it is possible to obtain an effect that the overall line resistance for the units arranged in the array of the source driver integrated circuit can be reduced, and the units forming the array can receive uniform power.

In addition, in the embodiment according to the present invention, it is possible to obtain an effect that the power lines are formed on the film in parallel to one another, so that line resistance for supplying power to the source driver integrated circuit can be reduced.

Figure 3:
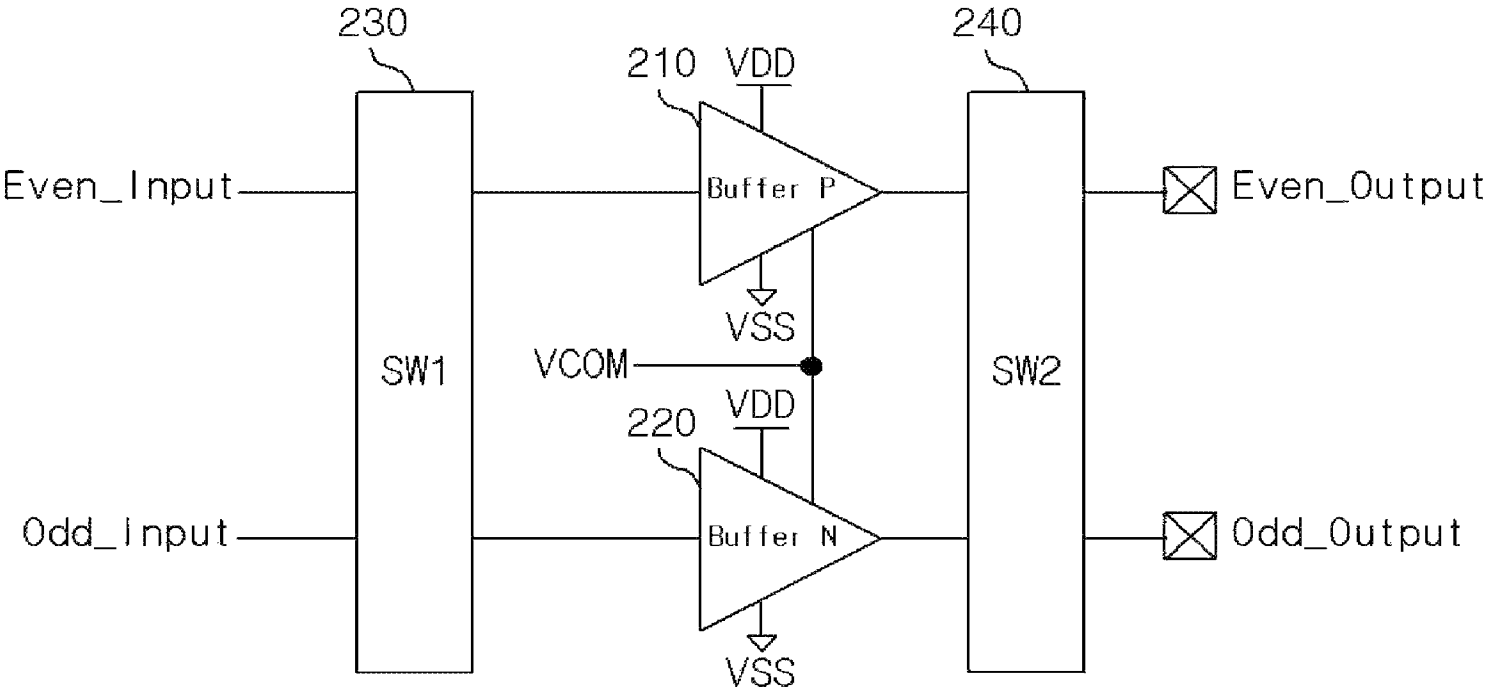
FIG. 3 is a circuit diagram illustrating an example of a channel amplifier of FIG. 2.

Furthermore, in the embodiment according to the present invention, the channel amplifiers CH11, CH12, CH21, and CH22 corresponding to the units may be provided as the circuit as illustrated in FIG. 3, and the voltage VCOM of FIG. 3 may be understood to correspond to the half supply voltage HVDD_O routed in the source driver integrated circuit of the embodiment of FIG. 1 and FIG. 2.

FIG. 3 is a circuit diagram illustrating an example of the channel amplifier of FIG. 2. In detail, FIG. 3 illustrates an output circuit of an even signal and an odd signal, which have polarities opposite to each other, of the source driver integrated circuit. The embodiment of FIG. 3 includes a switch 230 that selectively transfers an even input signal Even_Input and an odd input signal Odd_Input, a buffer 210 that buffers and outputs the even input signal Even_Input selectively output from the switch 230, and a buffer 220 that buffers and outputs the odd input signal Odd_Input selectively output from the switch 230. Furthermore, the embodiment of FIG. 3 includes a switch 240 that selectively outputs the even input signal Even_Input, which is output from the buffer 210, as an even output signal Even Output, and selectively outputs the odd input signal Odd_Input, which is output from the buffer 220, as an odd output signal Odd Output. The buffer 210 may be provided as a circuit that buffers a signal having a positive polarity, and the buffer 220 may be provided as a circuit that buffers a signal having a negative polarity.

One pair of buffers 210 and 220 are configured to use a voltage VDD and a voltage VSS as driving voltages, and the voltage VCOM corresponding to the half supply voltage HVDD_O is shared by the one pair of buffers 210 and 220.

The circuit illustrated in FIG. 3 may be provided as the channel amplifiers CH11, CH12, CH21, and CH22 of FIG. 2.

While various embodiments have been described above, it will be understood to those skilled in the art that the embodiments described are by way of example only. Accordingly, the disclosure described herein should not be limited based on the described embodiments.

What is claimed is:

1. A flat panel display apparatus comprising:

a source driver integrated circuit including units, which are commonly applied a same power to driving terminals and is arranged at both sides about a center to form an array, a first power pad and a plurality of second power pads for the power formed, nodes formed corresponding to both edges and the center of the array and the plurality of second power pads are connected to have a same line resistance, and including an amplifier having an output terminal connected to the node corresponding to the center of the array; and a film mounted thereon with the source driver integrated circuit, and formed a first power line connected to the first power pad and second power lines connected to the plurality of second power pads, one end of the second power lines being commonly connected to each other.

2. The flat panel display apparatus according to claim 1, wherein the amplifier amplifies the power applied to the first power pad.

3. The flat panel display apparatus according to claim 1, wherein the source driver integrated circuit receives the power from the first power pad and outputs the power routed in the source driver integrated circuit to the plurality of second power pads.

4. The flat panel display apparatus according to claim 1, wherein a half supply voltage is supplied as the power.

5. The flat panel display apparatus according to claim 4, wherein the unit includes a channel amplifier that outputs a source driving signal.

6. The flat panel display apparatus according to claim 1, wherein the second power lines have a same resistance.

7. The flat panel display apparatus according to claim 1, wherein a printed circuit board is electrically connected to one side of the film, and includes a stabilization capacitor for stabilizing the power of the plurality of second power pads and a third power line for a connection between the commonly connected one end of the second power lines and the stabilization capacitor.

8. A flat panel display apparatus comprising:

a printed circuit board including a stabilization capacitor and providing a first half supply voltage and a second half supply voltage charged in the stabilization capacitor;

a film formed a first power line for routing of the first half supply voltage and a plurality of second power lines for routing of the second half supply voltage; and a source driver integrated circuit mounted on the film, and formed a first power pad for a connection to the first power line, a plurality of second power pads for a connection to the plurality of second power lines, and including an amplifier that amplifies and outputs the first half supply voltage of the first power pad, units commonly using a second half supply voltage output from the amplifier and arranged at both sides about a center to form an array, and nodes formed corresponding to both edges and the center of the array and the plurality of second power pads are connected to have a same line resistance.

9. The flat panel display apparatus according to claim 8, wherein the unit includes a channel amplifier that outputs a source driving signal.

10. A source driver integrated circuit comprising:

a first power pad for input of a half supply voltage;

a plurality of second power pads for output of the half supply voltage routed in the source driver integrated circuit;

an amplifier that amplifies and outputs the half supply voltage of the first power pad; and units commonly using the half supply voltage output from the amplifier and arranged at both sides about a center to form an array, wherein nodes formed corresponding to both edges and the center of the array are connected to the plurality of second power pads to have a same line resistance, and wherein an output terminal of the amplifier is connected to the node corresponding to the center of the array.

11. A flat panel display apparatus comprising:

a first power pad for supplying a first half supply voltage;

units formed in an array and arranged in a source driver integrated circuit at both sides about a center of the array;

power lines having first ends commonly connected to each other and supplying a second half supply voltage;

a plurality of second power pads connected to second ends of the power lines, connected to each other by interconnections formed in the source driver integrated circuit, and supplying the second half supply voltage to nodes formed corresponding to both edges and the center of the array; and a half supply voltage amplifier having an output terminal connected to the plurality second power pads and the node corresponding to the center of the array by the interconnections, amplifying the first half supply voltage supplied from the first power pad, and outputting the second half supply voltage.

12. The flat panel display apparatus according to claim 11, wherein the power lines have a structure in which the first ends are commonly connected to each other, and the second ends are connected to the plurality second power pads, and the power lines are connected in parallel to each other by the interconnections for connecting the second power pads to each other.

13. The flat panel display apparatus according to claim 11, further comprising:

a stabilization capacitor connected to the first ends at which the power lines are commonly connected to each other and stabilizing the second half supply voltage.

14. The flat panel display apparatus according to claim 11, wherein the interconnection is configured such that nodes are formed corresponding to both edges and the center of the array, and the nodes and the plurality second power pads are connected to have a same line resistance.

15. The flat panel display apparatus according to claim 14, wherein the nodes are connected to driving terminals of the units forming the array.

16. The flat panel display apparatus according to claim 15, wherein the unit includes a channel amplifier that outputs a source driving signal.

17. The flat panel display apparatus according to claim 2, wherein a half supply voltage is supplied as the power.

18. The flat panel display apparatus according to claim 3, wherein a half supply voltage is supplied as the power.

* * * * *